United States Patent [19]

Sullivan et al.

[11] 4,384,508

[45] May 24, 1983

[54] DRUM MAGAZINE FOR A GUN

[75] Inventors: Leroy J. Sullivan; Robert L. Waterfield, both of Singapore, Singapore

[73] Assignee: Chartered Industries of Singapore Private Ltd., Jurong Town, Singapore

[21] Appl. No.: 280,177

[22] Filed: Jul. 6, 1981

[30] Foreign Application Priority Data

Dec. 11, 1980 [GB] United Kingdom ..... 8039745

[51] Int. Cl.[3] ..... F41D 10/24

[52] U.S. Cl. ..... 89/33 D

[58] Field of Search ..... 42/50; 89/33 D

[56] References Cited

U.S. PATENT DOCUMENTS

| | | |
|---|---|---|
| 2,321,720 | 6/1943 | Whittaker . |
| 2,585,738 | 12/1949 | Chapin et al. . |
| 2,715,290 | 8/1955 | Harvey . |
| 3,239,959 | 3/1966 | Sefried et al. . |

FOREIGN PATENT DOCUMENTS

| | | |
|---|---|---|
| 441561 | 5/1941 | Belgium . |
| 44923 | 10/1888 | Fed. Rep. of Germany . |
| 649860 | 9/1937 | Fed. Rep. of Germany . |
| 491235 | 5/1919 | France . |
| 110768 | 7/1925 | Switzerland . |
| 237418 | 8/1945 | Switzerland . |
| 9478 | of 1913 | United Kingdom . |
| 463691 | 4/1937 | United Kingdom . |
| 472784 | 9/1937 | United Kingdom . |
| 535325 | 4/1941 | United Kingdom . |

*Primary Examiner*—Stephen C. Bentley

*Attorney, Agent, or Firm*—Ladas & Parry

[57] ABSTRACT

A drum magazine for a gun has a housing with a feed throat extending from the housing and within the housing are mounted concentric sprockets. The sprockets have serrations for nesting cartridges and each sprocket is independently rotatable with stops for limiting the rotation of the outer sprocket and stops limiting rotation of the intermediate sprocket. A latch is arranged to prevent rotation of the outer sprocket in a counter direction to the direction of feeding cartridges out of the magazine until the intermediate sprocket is rotated in the counter direction a predetermined amount. A connector is connected to the outer sprocket and passes through the outer sprocket to engage with the cartridges nested in the intermediate sprocket so that by virtue of the connector, the sprockets rotate together. A similar connector is provided between the intermediate sprocket and the inner sprocket. A U-shaped pusher is provided to push the last few remaining cartridges in the magazine out of the feed throat.

27 Claims, 26 Drawing Figures

DRUM MAGAZINE FOR A GUN

This invention relates to a drum magazine for a gun.

Known drum magazines tend to suffer from friction losses caused by friction between the cartridges in the magazine and the internal surfaces of the magazine. Although it might be expected that there would be rolling friction with the cartridges, in fact, there is no rolling friction, but simply sliding friction.

One known drum magazine is the Thompson which is capable of holding up to fifty rounds and is described in "The World's Sub-machine Guns (Machine Pistols)", Volume 1 by Thomas B. Nelson, International Small Arms Publishers, Cologne, West Germany, first edition, second printing June 1964, pages 51 to 53. In the Thompson magazine there is a spiral guide in which the cartridges are arranged in, effectively, rows and the cartridges are swept out of a feed throat by six radial, rotating, arms driven by a spring which sweep all of the cartridges simultaneously around the rows. The friction in such a magazine is very great and it has been found that it is not practical to provide more than two spiral rows. However, it is possible to increase the capacity of such a magazine by increasing the drum diameter without increasing the number of rows, but the magazine then becomes undesirably bulky.

Figure 1:
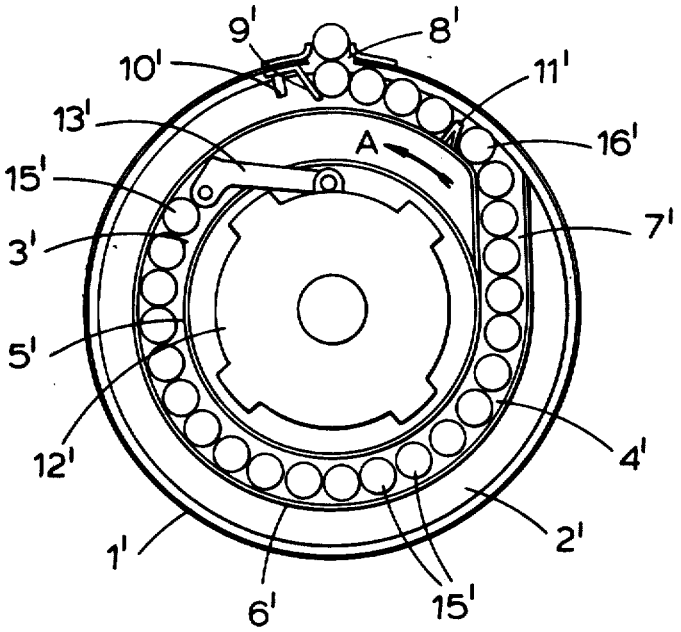
Figure 2:
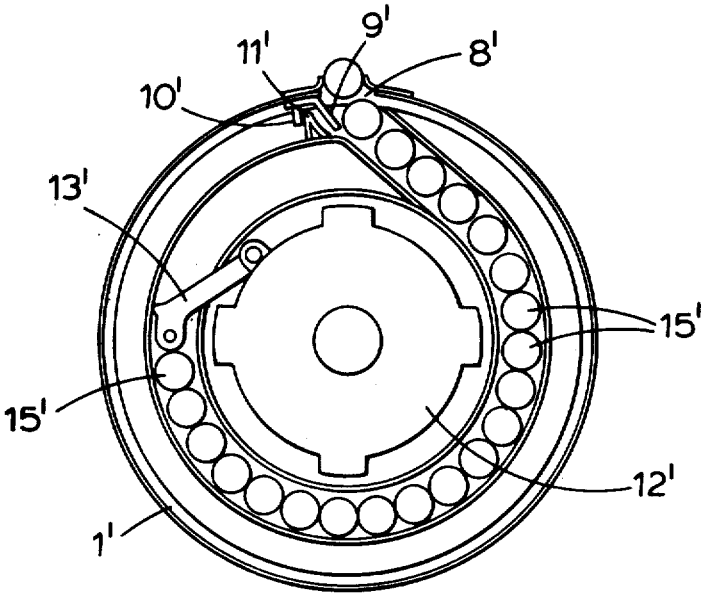

In an attempt to reduce the friction losses, a further known magazine is the Soumi drum magazine, described in the forementioned book at pages 562–565 and shown in FIGS. 1 and 2 of the accompanying drawings. In the Soumi magazine, a circular, pan-like housing 1' is provided having a rotatable base plate 2' upon which the cartridges sit in paths 3', 4' defined by concentric guides 5', 6' and the inner surface of the housing 1' respectively and a bridge 7' linking the paths 3', 4'; the guides 5', 6' and bridge 7' being rotatable with the base plate 2'. The housing has a throat 8', a feed ramp 9' and a stop 10' with which a lug 11' mounted on the guide 5' co-operates. A coil spring (not shown) beneath a rotor 12' drives the rotor and an associated pivotal pusher 13'. The cartridges are referenced 15' and the cartridge adjacent the lug 11' is referenced 16'.

In operation, the spring drives the rotor 12' and pusher 13' which applies pressure in the direction of arrow-headed line A, through all of the cartridges up to the lug 11' so that it is the pressure on cartridge 16' which drives the guides 5', 6' and the base plate 2'. The pressure on lug 11' thus urges the cartridges up the ramp 9' and through the feed throat 8'. There is, thus, frictional resistance between the cartridges in the outer row pushing outwardly against guide 1', although the inner row of cartridges is rotatably carried by the base plate 2' for the first partial revolution until the cartridges in the outer row are ejected through the throat 8' and this frictional resistance is less than that associated with the Thompson magazine. The friction is less than with the Thompson magazine because the guides 5', 6' that form the inside and outside diameter of the innermost row of ammunition moves with the ammunition for the first revolution. During that revolution, the outer row is driven out of the feed throat, but its inside diameter guide moves with it so that the outer row has only one half the sliding friction contact of the Thompson type and the inner row has none at all. When, however, the lug 11' engages the stop 10', the bridge 7' from the inner path 3' to the outer path 4' is in alignment with the feed throat 8' and the base plate 2' no longer rotates so that the inner row of cartridges abrade against the stationary guide surfaces, thereby producing a high friction force which is similar to that of the Thompson magazine. Additionally, because the pusher 13' exerts pressure on the last cartridge 15' in the magazine to drive all the other cartridges and because the cartridges are circularly arranged, the cartridges are forced outwardly against the guide surfaces, thereby increasing friction. It has, again, been found impractical to increase the number of paths to improve the capacity of such a magazine and if increased capacity is sought it is, once again, necessary to increase the drum diameter undesirably.

A further disadvantage of the forementioned drum magazines is that they can only readily be filled with cartridges by removing the circular planar cover, since they can only be filled through the feed throat by sliding cartridges between the feed lips in the axial direction of the housing.

The present invention seeks to provide a drum magazine of compact dimensions and of relatively large capacity which exhibits less friction to cartridge movement than the drum magazines described above.

According to this invention in its broadesst aspect, there is provided a drum magazine for a gun including a housing having a peripheral wall defining a circularly cross-sectioned interior, a feed throat extending through the said wall for releasing cartridges from the housing, and at least two rotatable concentric sprocket means, and aperture means for permitting cartridges to pass from the inner sprocket means to the outer sprocket means, the outer periphery of the sprocket means each having a plurality of serrations arranged to nest a plurality of cartridges.

Preferably, the sprocket means each comprise a concentric tubular member, at least two circular, radially extending flanges spaced therealong, each flange having serrations to nest a plurality of cartridges therebetween, the serrations on the flanges of the inner sprocket means being spaced from the inner surface of the next adjacent outer sprocket means by substantially the same distance as the serrations on the flanges of the outermost sprocket means are from the housing interior peripheral wall, a cartridge feed aperture in each tubular member except the innermost for permitting cartridges to pass through the apertured tubular members and feed ramp means arranged to guide cartridges from each of the sprocket means to the feed throat.

Advantageously, the feed ramp means comprise a ramp extending from the feed throat for scooping cartridges from the outermost sprocket means and a further ramp on one major side of the cartridge feed aperture in the tubular members extending inwardly for scooping cartridges from the adjacent inner sprocket means, and another ramp on the other major side of the cartridge feed aperture in the tubular members for guiding the cartridges along said further ramp.

Preferably, stop means are provided for sequentially limiting the relative rotation between each of the sprocket means and the housing which are arranged to sequentially align the ramps of the sprocket means in turn, starting with the outermost sprocket means. Advantageously, the stop means comprise co-operating abuttable stop members provided between the housing and the outermost sprocket means and between adjacent sprocket means except between the innermost sprocket means and the sprocket means adjacent thereto.

Preferably, the stop means include first co-operating stop members provided one on the housing and the other on the outermost sprocket means whereby, from a fully loaded position, the sprocket means rotate together until the cartridges in the outermost sprocket means have fed along said ramp through said feed throat whereupon the first co-operating stop members prevent further rotation of the outermost sprocket means, the further ramp on the outermost sprocket means aligns with the said ramp and the adjacent inner sprocket means continues to rotate and feed cartridges therefrom along said further ramp through the apertured tubular member of the outermost sprocket means and along said ramp to the feed throat.

In a currently preferred embodiment having three sprocket means, first co-operating stop members are provided, one on the housing and the other on the outermost sprocket means, and second co-operating stop means are provided, one on the outermost sprocket means and the other on the adjacent inner sprocket means.

Advantageously, the housing is a plastics moulding which is pan-shaped and has a cover also formed by moulding plastics and, conveniently, a recessed track is formed in the housing and cover for locating and guiding the sprocket means. Additionally, the sprocket means may also be made from a plastics material.

Advantageously, a pusher is provided which is mounted on the innermost sprocket means which is arranged to push those remaining cartridges not pushed by nested cartridges along the feed ramp means to the feed throat. Conveniently, the pusher comprises a U-shaped member with the free ends thereof mounted on a pivot extending between the flanges of the innermost sprocket means, each limb of the U-shape being adjacent an associated flange and a rod located along the base of the U-shaped member which is nested in similar fashion to the cartridges on the flanges, whereby the length of the limbs of the U-shaped member is sufficient to enable the last cartridge in the magazine to be pushingly fed by the rod to the outer extremity of the feed throat. Because the pusher is normally nested on the innermost sprocket means until the last six remaining rounds remain in the magazine, there is no pressure on the pusher and unlike the prior art the pusher does not have the function of pushing all of the cartridges to the feed throat outer extremity.

Preferably, the sprocket means are driven by a torsion spring, tensioned between a central axle and a slot in the tubular member of the innermost sprocket means.

Preferably, the serrations are arranged so that the cartridges, when nested in the serrations, have axes which are substantially parallel to the axes of the housing and sprocket means.

Advantageously, a guide is provided on the said ramp and said further ramp to tilt a cartridge passing therealong so that cartridges pass along the ramps in an inclined, nose-up, condition.

Preferably, the outer extremity of the feed throat is defined by a fixed lip extending over the feed throat and a spring-biassed pivotal lip, the spacing between the lips being such that a cartridge leaving the feed throat can only be slid therefrom in the direction of the housing axis. Advantageously, the pivotal lip is arranged such that by pressing a cartridge on the outer surface thereof, the pivotal lip is rotated to permit access of the cartridge to the feed throat in a direction substantially perpendicular to the housing axis. The pivotal lip, advantageously, has a tail portion which, when the magazine is in a gun receiver, prevents the pivotal lip from rotating. Preferably, the fixed lip is tapered in a direction to permit the nose of a cartridge to be directed upwardly away from the feed throat.

Preferably, latch means are provided between the housing and the outermost sprocket means and further latch means are provided between adjacent sprocket means except between the innermost sprocket means and the sprocket means adjacent thereto, each said latch means being engageable when the co-operating stop members abut each other such that each said latch means prevent rotation of an associated latched sprocket means until the serrations thereof are required to be filled with cartridges.

Conveniently, the latch means between the housing and the outermost sprocket means comprise a strip member pivotally connected to the outermost sprocket means and spring biassed toward the inner peripheral wall of the housing, and a recess or aperture in said peripheral wall, the strip member having an ear for engaging with the lip of the recess or aperture when the stop members associated with the housing and outermost sprocket means abut. The further latch means between adjacent sprocket means conveniently comprise a strip member pivotally connected to the inner of the two adjacent sprocket means which is spring biassed toward the inner wall of the tubular member of the adjacent outer sprocket means, and a recess or aperture in said inner wall, the strip member of the further latch means having an ear for engaging with a lip of the recess or aperture in said inner wall when the stop members associated with the adjacent sprocket means abut.

Advantageously, said strip member has a tang on the opposite side of the associated pivot from the ear, which tang passes through the tubular member of the sprocket means to which it is attached and toward the adjacent inner sprocket means, whereby the tang is arranged to have a length sufficient to be contacted by a cartridge on said adjacent inner sprocket means for the strip member to be rotated thereby such that the ear of the strip member disengages its associated lip and permits the sprocket means to which the strip member is attached to rotate. Because cartridges in the ramps are pushed outwardly by the force of the torsion spring, preferably the strip member is located in the wall of the tubular member of the sprocket means to which the strip member is attached and arranged to be depressed thereinto by cartridges on said sprocket means and, advantageously, the strip member has a finger adjacent said ear but directed inwardly to pass through an aperture in the tubular member of the sprocket means to which said strip member is attached, said finger having a length and position such that when the strip member is depressed by cartridges it is displaced between cartridges on the inner adjacent sprocket means to rotate said adjacent sprocket means in a direction against the spring force to thereby free the pressure on the cartridges in the ramps.

Advantageously, a last round stop actuator comprises a spring biassed member located adjacent to a limb of the pusher for travelling with said limb, whereby the spring biassed member is extended outside the housing when said pusher rod is extended toward the outer extremity of the feed throat.

In a currently preferred embodiment, the last round stop actuator is a leaf spring having one end connected to the pivot of the pusher and the other end thereof connected to a button, whereby the button is adjacent and biassed toward the cover and protrudes therefrom when the rod is extended in the feed throat. In an alternative embodiment, the last round stop actuator is a plunger and spring assembly located in the rod of the pusher arranged so that the plunger is adjacent and biassed toward the cover and protrudes therefrom when the rod is extended in the feed throat.

Preferably, the magazine is arranged to be held in position on the gun receiver by holes provided in one side of a neck partially bounding the feed throat which are spaced in the direction of the housing axis and by a radial key on the cover.

According to a feature of this invention, there is provided a detachable cartridge drum magazine for a gun including a housing having a peripheral wall defining a circularly cross-sectioned interior, a feed throat extending through said wall for releasing cartridges from the housing, said feed throat having opposing longitudinal sides located in the axial direction of the housing, and on each said side of the feed throat there being a lip, one lip of which is pivotally biassed toward a closed position which acts as a one way valve, whereby the lips are operative to prevent a cartridge from being ejected therefrom except by sliding in the axial direction of the housing, but said one lip is pivotal to an open valve position to permit cartridges to be fed into the feed throat in a direction perpendicular to the housing axis.

In said feature, preferably the other lip is fixed and partially extends over the feed throat and the pivotal lip is arranged such that by pressing the cartridge on the outer surface thereof the pivotal lip is rotated toward the feed throat to permit access of the cartridge to said feed throat.

According to a further feature of this invention, there is provided a drum magazine for a gun including a stationary housing, two substantially concentrically rotatably mounted members, drive means for rotating the members in a first direction, stop means for limiting rotation of the outer member with respect to the housing, and latch means between the outer member and the housing arranged to lock when the stop means limit the rotation of the outer member to thereby prevent rotation of the outer member in a counter direction to the first direction until the inner member is rotated in said counter direction a predetermined amount.

In a preferred embodiment of said further feature, said members each comprise a substantially concentric sprocket means, each said sprocket means having an outer periphery provided with a plurality of serrations arranged to nest a plurality of cartridges.

Conveniently, the sprocket means each comprise a concentric tubular member at least two circular, radially extending flanges spaced therealong, each flange having serrations arranged to nest a plurality of cartridges therebetween, the serrations of the innermost sprocket means being spaced from the inner surface of the next adjacent outer sprocket means by substantially the same distance as the serrations of the outermost sprocket means are from the housing interior peripheral wall, a cartridge feed aperture in each tubular member except the innermost for permitting cartridges to pass through the apertured tubular members and feed ramp means arranged to guide cartridges from each of the sprocket means to the feed throat. Alternatively, each sprocket means may be provided with the serrations directly in the outer periphery of the tubular member.

In an alternative embodiment of said further feature, the rotatably mounted members are concentrically arranged and the outer member comprises a base plate and cartridge guide rails extending from said base plate which define substantially concentric cartridge paths which are linked by a bridge. In said alternative embodiment, the inner member is a driving means which comprises a spring driven rotor connected to a pivotal pusher which is arranged to apply force to push the cartridges around said path means.

According to another feature of this invention, there is provided a drum magazine for a gun including a stationary housing, two substantially concentrically rotatably mounted members, at least one of said members being capable of supporting cartridges, drive means for rotating said members and a connector having a part thereof attached to one of said members through which drive is capable of predeterminedly passing from one of said members to the other said member such that the members rotate together and wherein disconnection of said connector enables one member to rotate with respect to the other member.

Advantageously, both members are capable of carrying cartridges.

Preferably, the members are sprocket means, each having an outer periphery in which is provided a plurality of serrations arranged to nest a plurality of cartridges. In a preferred embodiment of said another feature, the sprocket means comprise at least two circular, radially extending flanges axially spaced along a tubular member, each flange having serrations to nest a plurality of cartridges between the said flanges.

Preferably, the latch means in said further feature incorporate the connector of said another feature.

According to yet another feature of this invention, there is provided a drum magazine including a housing, means for supporting cartridges within said housing, a pusher which is capable of pushing remaining cartridges from said housing, and a last round stop actuator comprising a spring biassed member located adjacent to and arranged to travel with the pusher, whereby the spring biassed member is extended outside the housing when the pusher is extended toward the outer extremity of a feed throat of the housing.

Figure 3A:
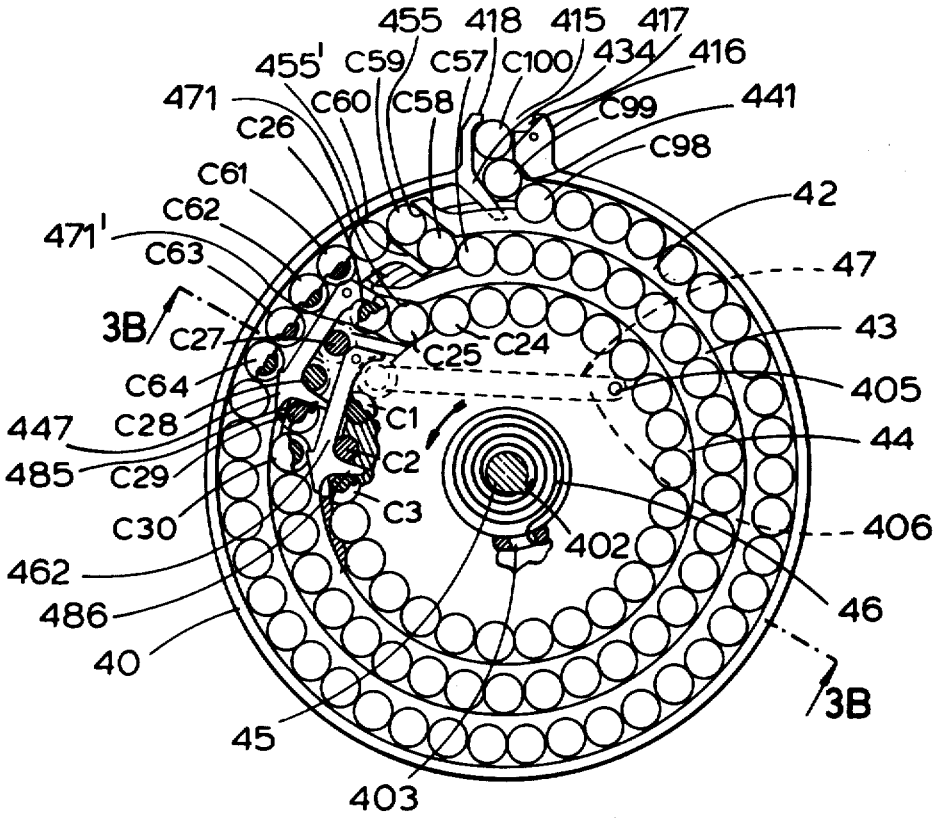
Figure 3B:
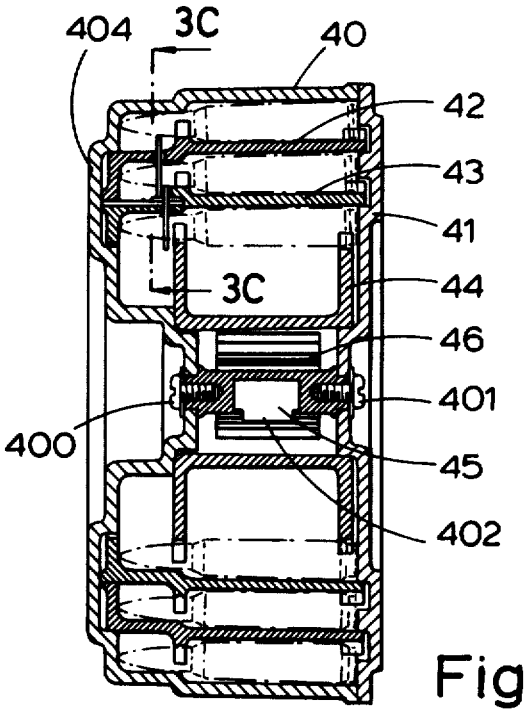
Figure 3C:
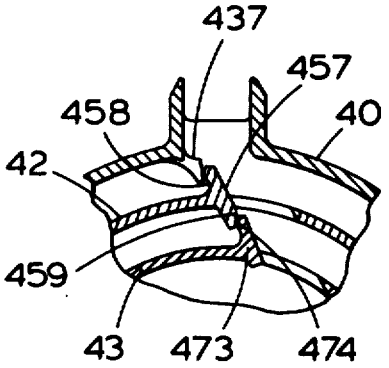
Figure 4:
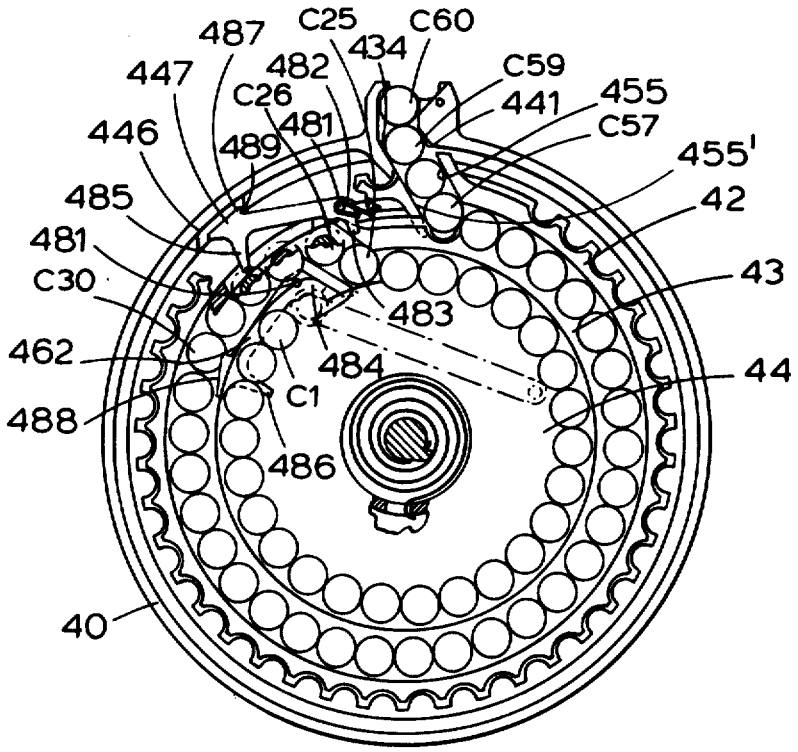
Figure 7B:
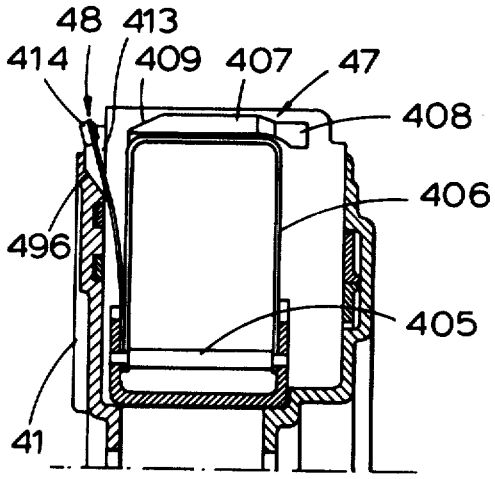
Figure 13:
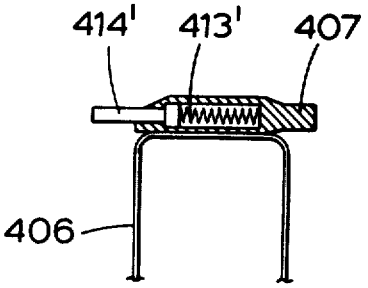
Figure 5A:
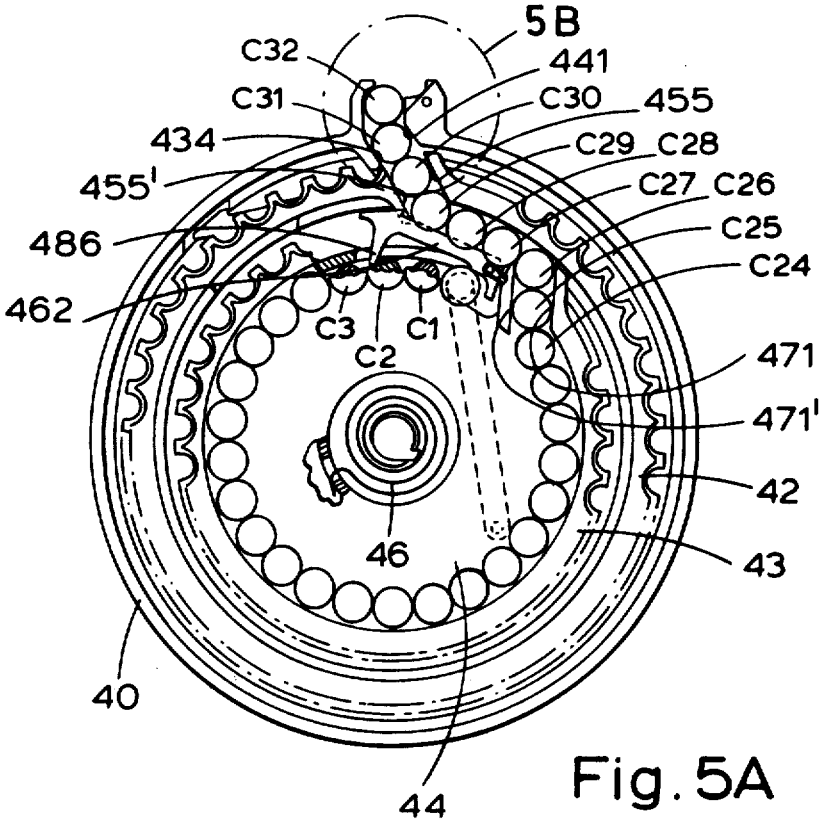
Figure 5B:
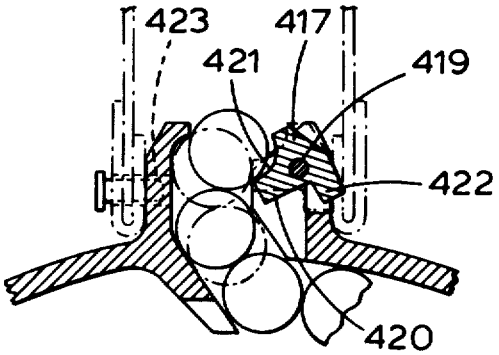
Figure 6:
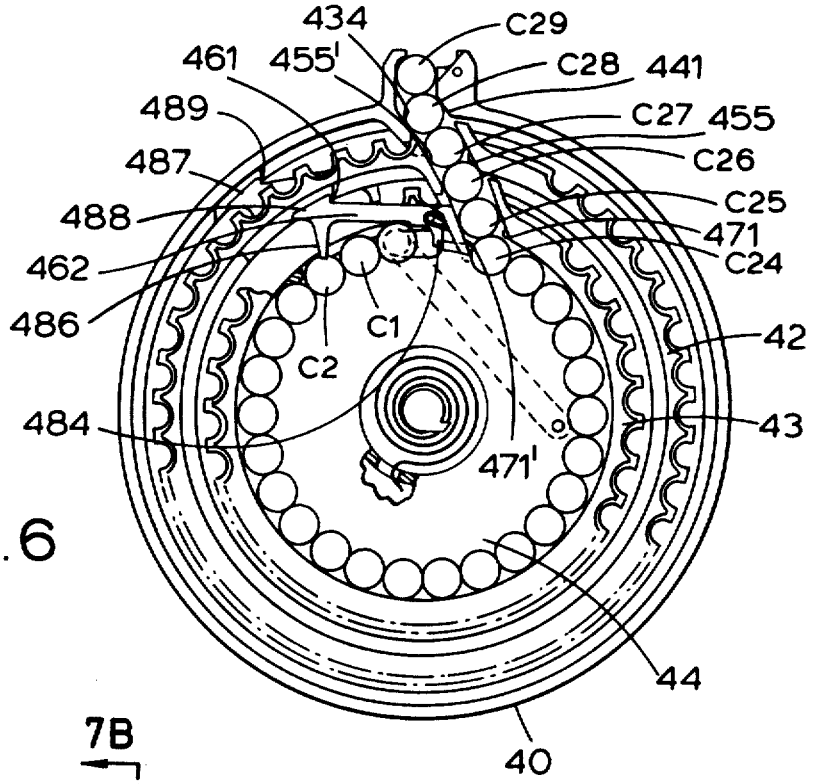
Figure 7A:
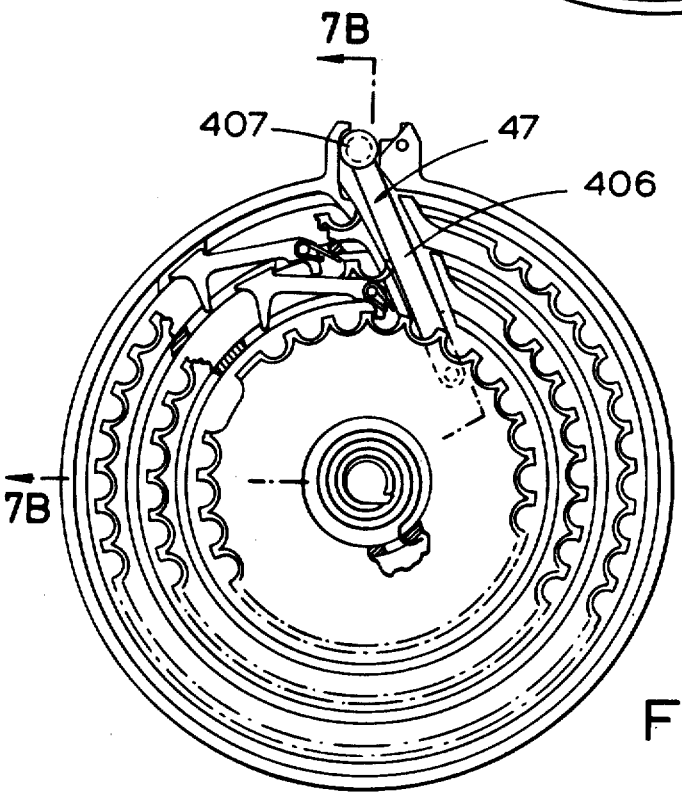
Figure 8A:
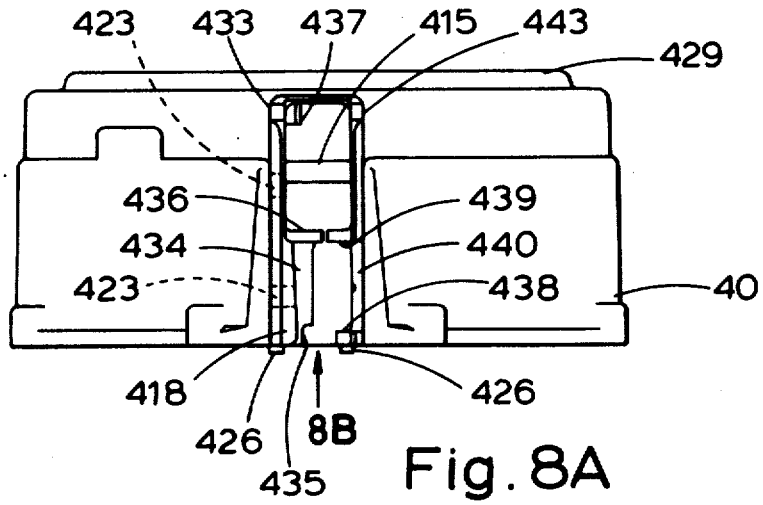
Figure 8B:
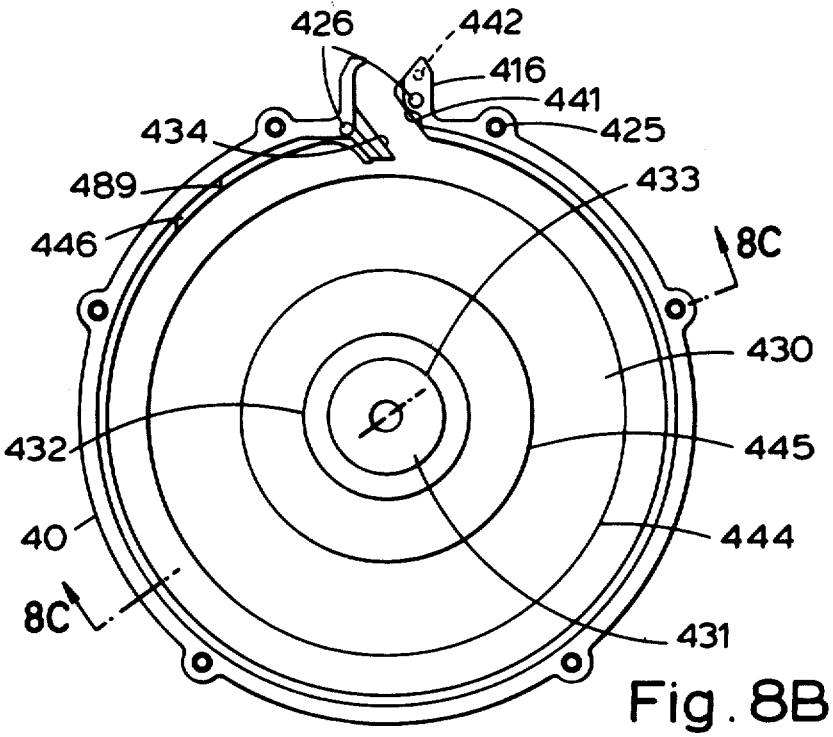
Figure 8C:
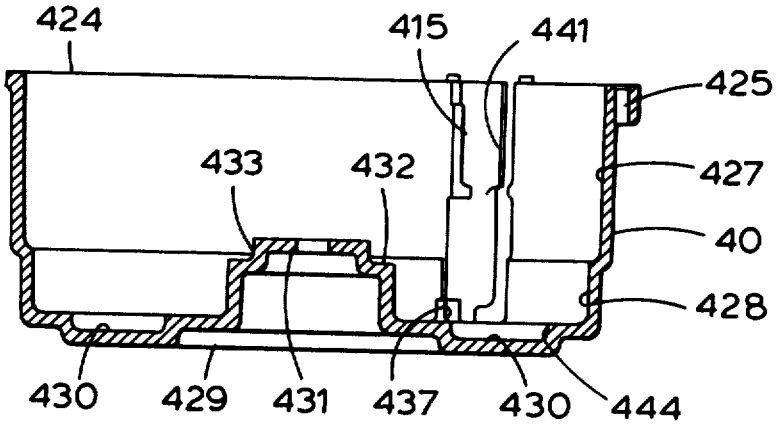
Figure 9A:
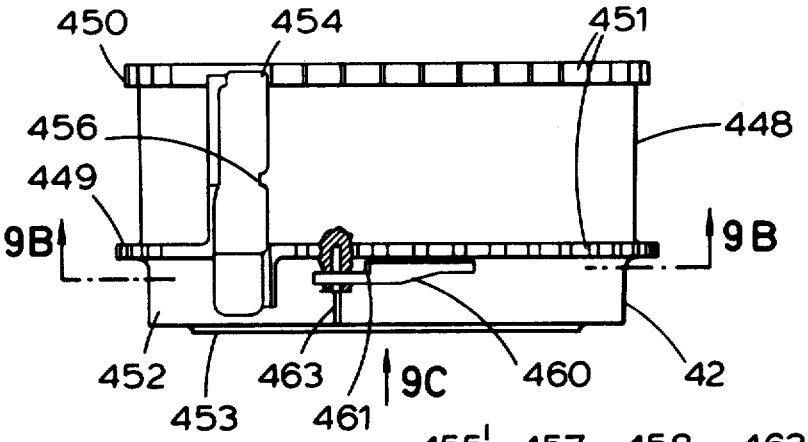
Figure 9B:
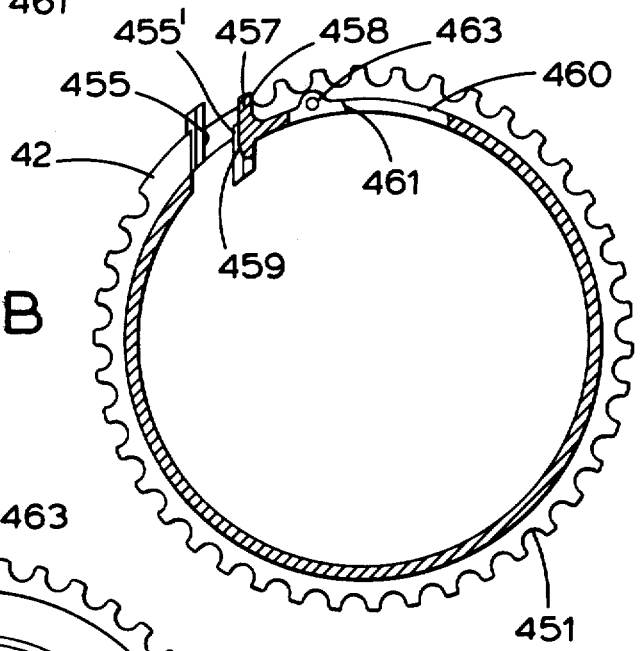
Figure 9C:
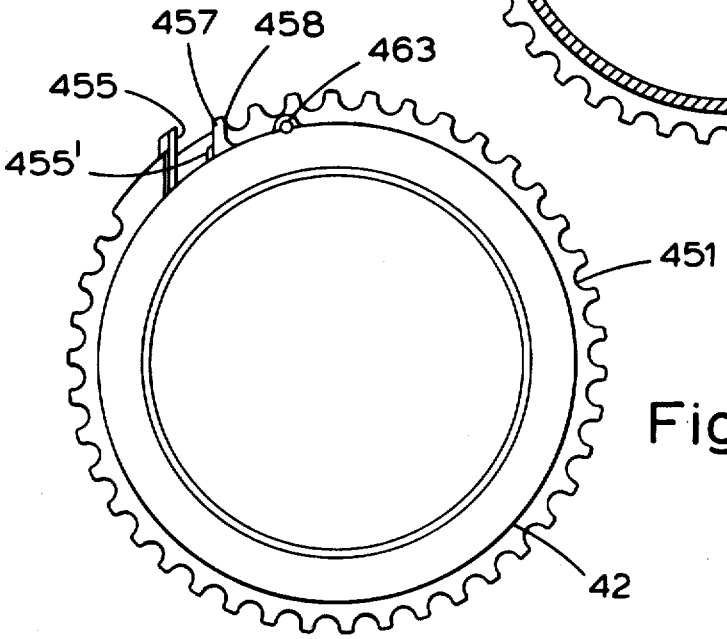
Figure 10A:
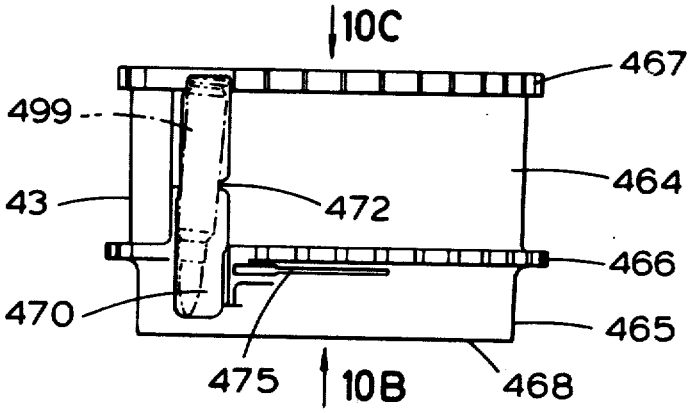
Figure 10B:
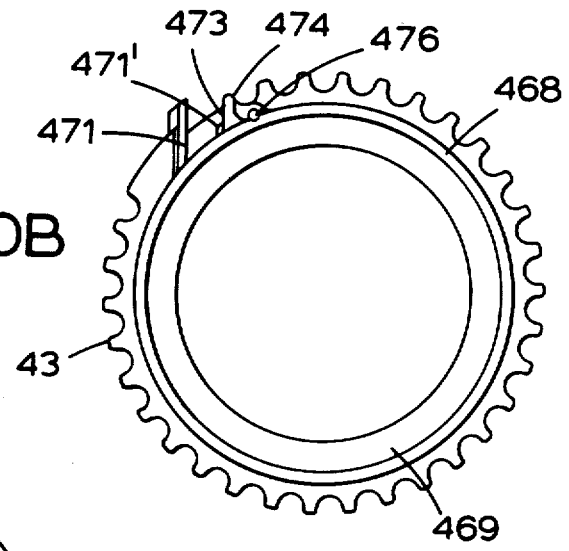
Figure 10C:
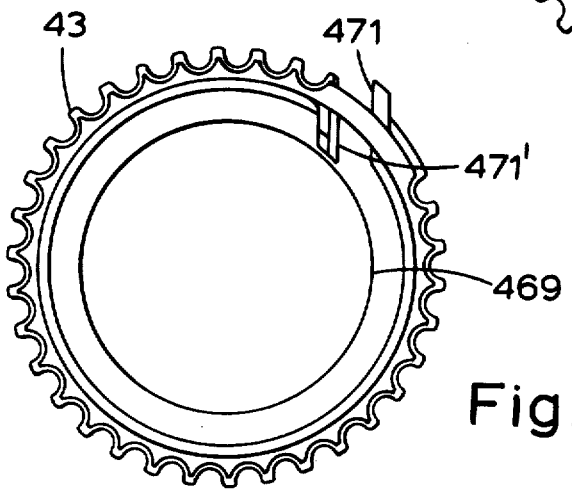
Figure 11A:
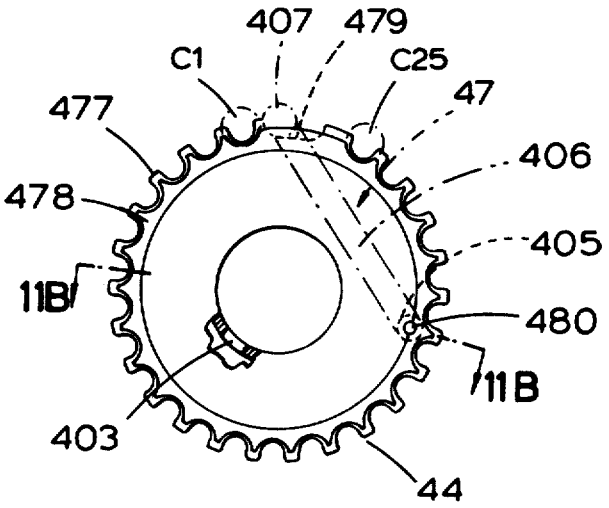
Figure 11B:
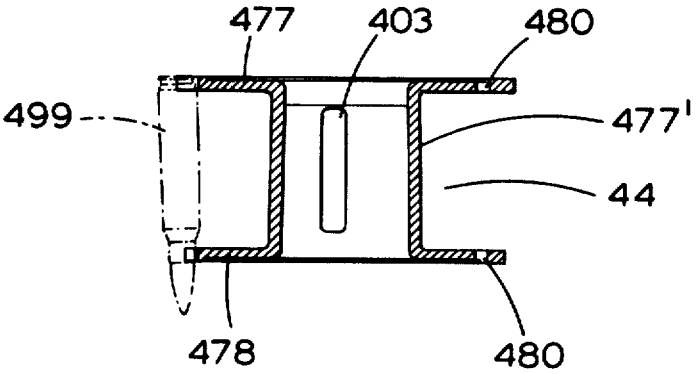
Figure 12A:
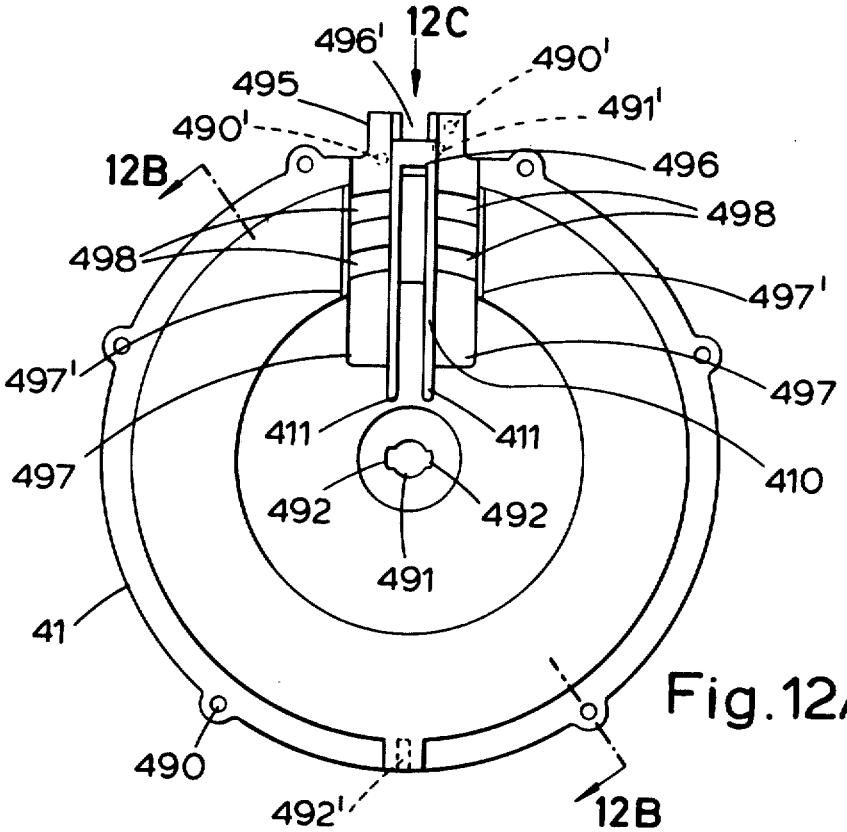
Figure 12B:
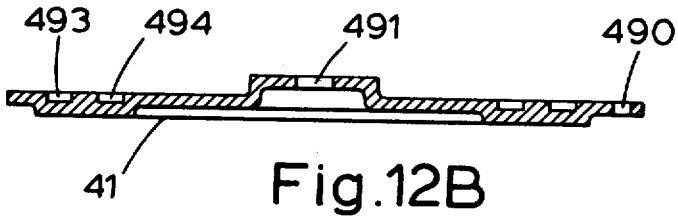
Figure 12C:
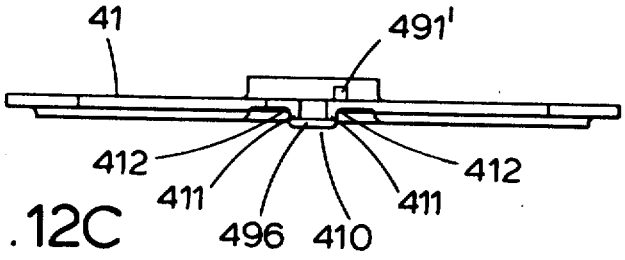

The invention will now be described, by way of example, with reference to the accompanying drawings, in which FIG. 1 shows a top plan view of a known Soumi Drum Magazine in one position of operation;

FIG. 2 shows the magazine of FIG. 1 in a further operational position;

FIG. 3A shows in partial section a schematic view of a drum magazine in accordance with this invention, FIG. 3B is a cross-section along double arrow-headed line 3B—3B of FIG. 3A, with the pusher removed, FIG. 3C is a view in the direction of double arrow-headed line 3C—3C of FIG. 3B showing the arrangement of the stops for the intermediate and outer sprockets but with the cartridges removed, FIG. 4 is a view similar to FIG. 3A but with the parts in different positions, FIG. 5A is a view similar to FIG. 3A but with the parts in a different position, FIG. 5B is a detail of the encircled portion arrowed 5B in FIG. 5A drawn to a larger scale and incorporating, in phantom lines, a part of the magazine well of the gun, FIG. 6 is a view similar to FIG. 3A but with the parts in a different position, FIG. 7A is a view similar to FIG. 3A but with the parts in a different position, FIG. 7B is a view along double arrow-headed line 7B—7B of FIG. 7A, FIG. 8A is a top view of the housing, FIG. 8B is a view in the direction of arrow-headed line 8B of FIG. 8A, FIG. 8C is a cross-sectional view along double arrow-headed line 8C—8C of FIG. 8B, FIG. 9A is a side view of an outer sprocket, FIG. 9B is a cross-sectional view along double arrow-headed line 9B—9B of FIG. 9A, FIG. 9C is a view in the direction of arrow-headed line 9C in FIG. 9A, FIG. 10A is a side view of an intermediate sprocket, FIG. 10B is a view in the direction of arrow-headed line 10B of FIG. 10A, FIG. 10C is a view in the direction of arrow-headed line 10C of FIG. 10A, FIG. 11A is a plan view of an inner sprocket, FIG. 11B is a view along double arrow-headed line 11B—11B of FIG. 11A, FIG. 12A is a top plan view of a cover, FIG. 12B is a cross-sectional view along double arrow-headed lines 12B—12B of FIG. 12A, FIG. 12C is a view in the direction of arrow headed-line 12C of FIG. 12A, and FIG. 13 is a partial view of an alternative last round stop actuator.

In the FIGS. 3A–13 like references denote like parts.

In the FIGS. 3A, 4, 5A, 6 and 7A the cartridges are denoted by the prefix C so it will be seen from FIG. 3A that in the fully loaded position the magazine holds 100 cartridges.

The drum magazine shown in FIGS. 3A to 7B has a circularly cross-sectioned, pan-shaped housing 40 having a cover 41 within which is concentrically mounted an outer sprocket 42, an intermediate sprocket 43, and an inner sprocket 44. The drum, cover and each of the sprockets are made from moulded plastics and each of the sprockets is spool-shaped having a central tubular body and at each end of the body is a radially extending flange each having a like number of serrations around the outer periphery for holding cartridges. The serrations in the flanges adjacent a base 404 of the housing have a greater radial extent than the serrations in the arms adjacent the cover 41 to allow for the taper of a cartridge and so that the cartridge axes are approximately parallel to the axis of the housing. The inner sprocket 44 has serrations to hold each of cartridges C1–C24, the intermediate sprocket 43 has a serration to hold each of cartridges C27–C57 and the outer sprocket 42 has a serration to hold each of cartridges C60–C98. In the assembled position, shown in FIGS. 3A–7B, the sprockets are located in the housing 40 so that feed ramps 434, 441 on the housing, 455, 455' on the outer sprocket, and 471, 471' on the intermediate sprocket adopt the positions shown in FIG. 3A and the feed ramp 434 extends to the base of cartridge C98, the feed ramp 455' extends to the base of cartridge C58 and the feed ramp 471' extends to the base of cartridge C25. In this way the feed ramps are effective to scoop up the cartridges in the sprockets with which the ramps are associated and the ramps 441, 455', 471' act as guides for the cartridges. Mounted to be fixed on the axis of the housing 1 is a nylon spindle 45 secured to the housing and cover respectively by screws 400,401. The spindle has an ear 402 to which is secured one end of a sheet metal clock-type torsion spring 46, the other end of the spring 46 being secured to an aperture 403 in the inner sprocket 44.

As best shown in FIG. 7B and in phantom lines in FIG. 11A, a pusher 47 is mounted on the inner sprocket 44. The pusher 47 has a spindle 405 positioned between the arms of the inner sprocket and pivotally mounted on the spindle 405 is a U-shaped arm 406 with the limbs of the U-shape within the confines of the inner sprocket flanges and adjacent a respective flange. The free ends of the U-shape are secured to the spindle 405 and a rod 407 having the approximate shape of a cartridge is welded to the base of the U-shape. The rod 407 has a tail 408 which is locatable in a serration of the inner sprocket and a bevelled top portion 409 (as viewed in FIG. 7B) remote from the tail 408 to facilitate a bolt of the gun to which the magazine is secured to ride over the rod 407. Connected to the spindle 405 between the U-shaped arm 406 and the wing of the inner sprocket adjacent the cover 41 is a last round stop actuator 48 comprising a spring arm 413 which is biassed toward the cover 41 and a button 414 which may contact a mechanism within a gun receiver to which the magazine is mounted so that when the last cartridge from the magazine is fired the bolt mechanism can be held in the cocked position. It is in the event that the last round stop actuator fails to operate the mechanism within the gun receiver that the bevelled portion 409 is provided so that the bolt will strike the pusher obliquely to the bevel. The tail 408 of the pusher is extended so that it may co-operate with a sprocket latch, as will be described later herein.

The housing 40 has a feed throat 415 defined by a neck 416 having longitudinal sides in the axial direction of the housing and which is arranged to be located in the magazine well of a gun. The neck 416 has, on its right hand side (as viewed in FIGS. 3A and 4–7A), a pivotal lip 417 and on its left hand side an arcuate, fixed lip 418 extending over the feed throat. Referring particularly to FIG. 5B, the neck of the magazine is shown located in a well of a gun (the well being shown in phantom lines). The pivoting lip 417 is mounted on an axle 419 and has an arm 420 with an arcuate upper surface 421, generally the same radius as a cartridge, and a tail 422 of such a length that, when the magazine is inserted into the well of a gun, the tail prevents rotation of the lip 417 so that it is not possible for the lip 417 to adopt the position shown in solid line in FIG. 5B when mounted in the gun well. The lip 417 is biassed by a spring (not shown) so that the bottom of the lip (as viewed in FIG. 5B) is normally horizontal, as shown in phantom lines. The distance between the lips 417 and 418 is arranged so that with the lip 417 spring biassed in a clockwise direction (as shown in FIG. 4 for example and in FIG. 5B in phantom lines) it is not possible for a cartridge to be removed from above the lips so the cartridges may not fall out of the magazine. When the magazine is removed from the gun the cartridge may, however, be unloaded from the magazine in a direction perpendicular to the cartridge longitudinal axis by depressing lip 417. In use, the cartridges are axially slid from the magazine by a bolt of the gun. A latching mechanism is provided to secure the magazine to the well of the gun and, conveniently, such a mechanism comprises a pair of pins which may be slidably mounted through one of the walls of the magazine well into co-operating holes in the neck 416 of the housing, these holes being referenced 423 in FIG. 8A and one of the pins being shown in phantom lines in FIG. 5B.

The pan-shaped housing 40, shown in FIGS. 8A, 8B and 8C has an open top 424 to which the cover 41 is connected by internally screw threaded bosses 425 and located by pins 426 on each side of the neck 416. The housing 40 has a large internal diameter portion 427 for accommodating the body of the cartridge in the outer sprocket and a reduced internal diameter portion 428 in the region of the nose (bullet) portion of the cartridge and the portion 428 is connected to a base 429. The base has a circular protrusion 430, the interior of which acts as a bearing surface upon which the outer sprocket 42 and intermediate sprocket 43 rotate. In this respect, the concentric protrusion 430 has a radially outer side 444 to concentrically locate the outer sprocket 42 and an inner side 445 to locate the intermediate sprocket 43 in a concentric fashion. The base 429 is dished to provide an inner boss 431 providing a bearing surface 432 and a concentric guide surface 433 for the inner sprocket 44. On the axis of the drum in the boss 431 is a hole for the screw 400. The fixed lip 418, as best seen in FIG. 8A, is tapered inwardly of the housing so as to permit cartridges which are trapped by the lips 417, 418 to be tilted such that the bullet is angled upwardly, the relieved portion of the fixed lip 418 permitting the cartridge body to rise slightly higher than the region of the cartridge toward the cannelore. This allows the cartridge to assume an ever increasing upward angle as it is driven in operation forwardly by the bolt so that it can enter the chamber smoothly without the base or cannelore end being forced downwardly. Such action is in distinction to the usual feed path of conventional magazines where, as the cartridge is driven forwardly, the bullet end is forced upwardly as it enters a feed ramp and the base end goes downwardly. This is because the forward corner of the conventional feed lip contacts the center, body, portion of the cartridge and acts as a fulcrum so that as the bullet end rises the base end is forced downward, thus causing the other cartridges in the magazine to be pushed downward in the magazine. In magazines of large capacity such reversing action (driving the bulk of the cartridges backwardly) requires substantial short term energy and has the undesirable effect of retarding bolt motion.

On the side of the feed throat 415 adjacent the fixed lip 418 is a feed ramp 434 having at its outer side a notch 435 to accommodate the serrations of the outer sprocket and at the inner side of the feed ramp 434 is a web guide 436 for the cartridges. Also provided on the same side of the throat as the fixed lip is a stop 437 for the outer sprocket. The pivoting lip 417 is located in a cutout defined by side walls 438 and 439 and a bottom part 440, the side wall 439 having an internal ramp portion 441 which also acts as a guide for feed ramp 434. A hole 442 in both side walls 438, 439 is for the axle 419 of the pivoting lip 417. Both sides of the feed throat 415 have notches 443 which, in operation, abut against respective stop pins in the well of the gun to limit the extent of insertion of the magazine into the receiver.

As shown in FIG. 8B, the internal diameter portion 428 has a recess 446 for co-operating with a latch 447 provided on the outer sprocket. Alternatively, instead of a recess, an aperture could be provided.

Referring now to FIGS. 9A, 9B and 9C, the outer sprocket 42 has a tubular body 448 with flanges 449, 450 each having a like number of serrations 451 in which are located, between the flanges 449, 450 cartridges. For reasons discussed earlier, the serrations in flange 449 have a greater radial extent than those in flange 450. The body 448 has a reduced diameter portion 452 which sits within the internal diameter portion 428 of the housing and a concentric bearing surface 453 which engages the internal side of the protrusion 430. The body 448 has a feed aperture 454 to permit cartridges from the intermediate and inner sprockets to pass therethrough. The feed aperture 454 has feed ramps 455, 455' and a guide ramp 456 arranged to tilt the cartridge so that the bullet portion is inclined outwardly of the feed aperture 454. Located in the reduced diameter portion 452 is a stop 457 presenting a stop surface 458 for contacting the stop 437 of the housing and a further stop surface 459 for co-operating with a stop on the intermediate sprocket. The wall of the portion 452 has an aperture 460 shaped to house the latch 447 and to form a lip 461 against which a claw on a latch 462, connected to the intermediate spool, co-operates. Transversely to the aperture 460 is a hole 463 in a boss for a pin pivotally locating the latch 447. The reduced diameter portion 452 is arranged to locate the neck of a cartridge so as to maintain the cartridge with the required amount of tilt in the magazine. The latch 447 is bent into the shape of a dog leg so that it is able to overlap the latch 462.

The intermediate spocket 43, shown in FIGS. 10A, 10B and 10C, is similar to the outer sprocket 42 and has a body 464 with a reduced diameter portion 465 and serrated flanges 466 and 467 between which cartridges are held. The radial extent of the serrations in flange 466 is greater than that of those in flange 467 for the reason discussed earlier. The end face of the reduced diameter portion 465 has a bearing surface 468 for rotating on the surface 430 of the housing and a recessed annular part 469, the inner periphery of which acts as a concentric guide surface to abut the inner side 445 of the housing. The intermediate sprocket has a feed aperture 470 having feed ramps 471, 471' and in which is disposed a cartridge 499 that is tilted by a guide ramp 472, as described in relation to the outer sprocket 42. The guide ramp 471' extends interiorally of the body 464. A stop 473 having a stop surface 474 for contacting the stop 459 on the outer sprocket 42 is provided on the reduced diameter portion 465 and in the side wall of the reduced diameter portion 465 is an aperture 475 for the latch 462 and a hole 476 is provided in a boss for a pin locating the latch 462.

The inner sprocket 44, shown in FIGS. 11A and 11B, has a body 477' with serrated side flanges 477, 478 and the body 477' has the rectangular aperture 403 within which one end of the spring 46 is located. The radial extent of the serrations in flange 477 is greater than that in the flange 478 to tilt the cartridge (shown in phantom lines). In the position between which cartridges C1 and C25 (shown in phantom lines) are located is a notch 479 in the arm 477 within which the rod 407 of the pusher is locatable. A hole 480 is provided in each of the arms 477 and 478 for the spindle 405 of the pusher.

The latches 447 and 462 are both formed from strip material and, as best shown in FIG. 4, both mounted on a respective pivot 481 and both biassed by a respective torsion spring 482, one end of which engages with an edge of slot 460, 475 respectively and the other end of which is bent into an L-shape and engages a tang 483, 484 respectively of the latches 447 and 462. At the end of the latches 447, 462, remote from the tangs, is a finger 485, 486 respectively and a protruding ear 487, 488 respectively; the car 487 engaging with a lip 489 on the recess 446 of the housing 40 and the ear 488 being arranged to engage with the lip 461 on the outer sprocket 42 (as shown in FIG. 6). The fingers 485 and 486 are both shaped to be inserted between cartridges C28 and C29 and between cartridges C2 and C3 respectively and to bear against cartridges C28 and C2 respectively. The tangs 483 and 484 have a radius portion which is arranged to be engaged by cartridge C26 and the rod 407 of the pusher 47 respectively.

Referring now to FIGS. 12A, 12B and 12C, the cover 41 is a moulding made from clear plastics having a circular shape with six holes 490 located in protrusions of the cover for securing the cover to the housing 40. The cover has an axial hole 491 formed with notches 492 which act as a keyway for the spindle 45 and prevent the spindle 45 from rotating. The region surrounding the hole 491 is dished to provide a recess for the head of screw 401 and the underside of the cover has concentric ring slots 493, 494 for the flanges 450, 467 of the outer and intermediate sprockets respectively. To facilitate the provision of the slots 493, 494 the cover is locally thickened. Shown symmetrically about the horizontal axis in FIG. 12A is a key 410 formed from ribs 411 with a root radius 412 between the ribs and the planar part of the cover. The cover has a neck 495 corresponding in part to the neck 416 of the housing and positioned partially down the neck and extending toward the hole 491 is a guide cover 496 which is chamfered toward the cover outer surface (as best shown in FIG. 7B) to guide the actuator 48 in and out of the housing. The region 497 on each side of the ribs 411 is relieved to provide an improved depth of the ribs 411 upon which a keyway on the gun receiver may engage and because of slots 493 and 494, arcuate apertures 498 are formed. The guide cover 496 is recessed to provide a slot 496' of such depth that the cover 496 clears a normally provided last round stop in the gun receiver. The confluence of the relieved portion 497 and the thickened portion of the cover has a bevelled edge 497' to ease the location of the magazine onto the receiver keyway. The neck 495 is of such a length that it partially covers a top most cartridge to prevent the cartridge from moving rearwardly. Holes 490' are provided on the neck 495 within which the pins 426 on the housing are located and a protruding pin 491' extending on the underside of the cover forms part of the feed ramp for the cartridges. A water drain hole 492' is provided on the inside surface of the cover.

In the position shown in FIG. 3A, the latches 447 and 462 are held downwardly by cartridges C64 and C30 respectively and the fingers 485 and 486 respectively are, thus, forced between cartridges C28, C29 and C2, C3 respectively. The action and purpose of the fingers 485 and 486 will be described later.

In operation, the spring 46 drives the sprockets in an anti-clockwise direction (as viewed in the FIGS. 3A, 4, 5A and 6) so that starting with the magazine fully loaded, as shown in FIG. 3A, cartridge C2 pushes on finger 486 which, because latch 462 is connected by pivot 481 to the intermediate sprocket 43, causes sprocket 43 to rotate in an anti-clockwise direction. The turning effort of intermediate sprocket 43 is, thus, applied to cartridge C28 which, in turn, applies a pressure through finger 485 of latch 447 to the outer sprocket 42 which, thus, also is rotated in an anti-clockwise direction.

The rotation of the outer sprocket 42 causes cartridge C98, located in a serration of the flanges 449, 450, to push against cartridges C99 and C100 and the cartridge C100 is prevented from being ejected from the throat 415 of the magazine by the lips 418, 417. It will, thus, be seen that the dimension between the lips 417, 418 is extremely important.

When the magazine is inserted into a gun magazine well (as shown in FIG. 5B) the magazine is held in position by pins (shown in phantom lines) which locate in the holes 423. Assuming that the bolt has been cocked, then on releasing the gun trigger the bolt moves forwardly toward the barrel and a stripping lug associated with the bolt slidingly removes the cartridge C100 from the lips 417, 418 in a direction perpendicular to the plane of the FIG. 3A, i.e., in a direction from right to left in FIG. 3B which is also in the direction of the housing axis. The cartridge C100 is, thus, pushed from the magazine into the chambers. Due to continued force being exercised by the spring 46 on the sprockets, so the sprockets rotate in an anti-clockwise direction and cartridge C99 is moved upwardly to be held by the lips 417, 418 and cartridge C98 is, thus, scooped out of the serrations in flanges 449, 450 by the ramps 434. This action continues until the outer sprocket 42 has given up all of its cartridges C98–C60 and the stop surface 458 on outer sprocket 42 contacts stop 437 on the housing 40 (as shown in FIG. 3C). The positions of the stops 437 and 457 are such that the feed ramps 434 and 441 on the housing align with feed ramps 455' and 455 respectively of the outer sprocket 42. Whilst the outer sprocket was rotating and when cartridges C64, C63, C62 are denested and move up to the ramp 434, so the latch 447, which has heretofore been held depressed by cartridges C64, C63, C62 is released and is biassed by spring 482 so that the ear 487 abraids the internal diameter portion 427 of the housing and continued rotation is such that when the stop surface 458 abuts stop 437 so the ear 487 engages lip 489 and the outer sprocket 42 is prevented from rotating clockwise. The parts of the magazine are, thus, in the position shown in FIG. 4.

Continued feeding of the cartridges from the feed lips causes those cartridges on the intermediate sprocket 43 to be expended and the arrangement to adopt the position shown in FIG. 5A with the cartridge C30 being scooped by ramp 455' to move up the feed ramps 455', 455. Continued rotation of the inner sprocket 44 causes the stop surface 474 to stop 473 on the intermediate sprocket 43 to abut the stop surface 459 on the outer sprocket (as shown in FIG. 3C) and the feed ramps 471', 471 of the intermediate sprocket 43 to align with the feed ramps 455', 455 respectively of the outer sprocket 42 (as shown in FIG. 6) and the latch 462 is spring biassed so that the ear 488 engages with the lip 461 on the outer sprocket 42.

Continued release of the cartridges causes further rotation of the inner sprocket 44 so the cartridges C24–C1 pass up the feed ramps 471', 471, 455', 455, 434 and 441 and because there are no further cartridges to push cartridges C6–C1 up the feed ramps so the rod 407 of the pusher 47 is scooped up by the feed ramp 471' to push these cartridges up to the feed lips, the length of the arm 406 being such that the rod is able to extend to the feed lips 417, 418 (as shown in FIGS. 7A and 7B). Connected at one side of the arm 416 is the last round stop actuator 48 and as the pusher 406 extends up the feed ramp so the spring arm 413, which is biassed against the guide cover 496 on the cover 41, moves with the arm upwardly and outwardly through the slot 496' in the cover. Until the pusher starts to move, the last round stop actuator 48 is mounted alongside the U-shaped arm 406 of the pusher. The action of the last round stop actuator button 414 is to move a bolt latch in the gun to latch the bolt assembly in an open position so that when the next magazine is inserted in the gun the bolt is already cocked.

To load the magazine, cartridges are inserted through the feed throat 415 in a direction perpendicular to the housing axis so that the cartridges are inserted into the upper surface 421 of the spring biassed pivoting lip 417 and downward pressure on the cartridges causes the pusher 407 to be partially depressed and the lip 417 to be rotated to the position shown in solid lines in FIG. 5B. After loading six cartridges the pusher 47 is laid in its rest position on the inner sprocket and the insertion of further cartridges cause the cartridge C1 to be nested in the first of the serrations on the inner sprocket 44. The action of depressing the pusher 47 is, of course, against the force exerted by spring 46 and as the cartridges C1–C24 are nested in their associated serrations so the inner sprocket 44 is rotated in a clockwise direction. When cartridge C30 is inserted in to the feed lips the pusher tail 408 contacts tang 484 on the latch 462 and thereby rotates the latch 462 so that the ear 488 is disengaged from the lip 461. The intermediate sprocket 43 is, thus, free to rotate in a clockwise direction and, with the insertion of cartridges C31 and C32, adopts the position shown in FIG. 5A. Referring to FIG. 5A, the insertion of cartridges C31 and C32 causes cartridges C28, C29 to depress the latch 462 so that the finger 486 is inserted between the cartridges C2, C3 (see FIG. 4). Continued clockwise rotation of the intermediate spool 43 and inner spool 44 causes the latch 462 to be fully depressed by cartridges C30, C29, C28 and the finger 486 to be firmly pushed between cartridges C2, C3, and to bear against cartridge C2.

The function of the finger 486 is as follows:

With the parts shown in the positions of FIG. 5A the spring 46 exerts a pressure through cartridges C24, C25 and C26, causing cartridge C26 to be forced against the inner wall of the outer sprocket 42, thus resulting in undesirable friction. However, with the downward pressure of cartridge C30 on the latch 462, as shown in FIG. 4, so finger 486 pulls cartridge C2 and, thus, the inner sprocket 44 in a clockwise direction relative to the intermediate sprocket 43. In this manner, the pressure from spring 46 upon cartridges C24, C25, and C26 is released and the cartridges C25, C26 have a small amount of freedom within the feed ramps 471' and 471 and the forementioned undesirable friction is removed.

Continued feeding of cartridges into the feed throat 415 causes both inner sprocket 44 and intermediate sprocket 43 to be rotated in a clockwise direction until cartridge C26 is rotated so that it abuts the tang 483 on latch 447. The latch 447 is, thus, rotated against the bias of its associated spring 482 so that the ear 487 is moved out of abutting contact with the lip 489 and, thus, permitting the outer sprocket 42 to rotate in a clockwise direction. The position shown in FIG. 4 is where the cartridge C26 is about to abut the tang 483. Continued filling with cartridges is such that the cartridges C64, C63, C62 force the finger 485 of latch 447 to pull the cartridge C28 in a clockwise direction and, hence, the intermediate sprocket 43 is moved in a clockwise direction relative to the outer sprocket 42 and the cartridges C57, C58 and C59 are freed from a tight fit against one another, in similar manner to the action of finger 486 upon cartridges C24, C25 and C26. Thus, the cartridges C58 and C59 have a small degree of freedom within the feed ramps 455' and 455 and undesirable friction between C59 and the inner wall of the housing 40 is eliminated. Thus, all of the cartridges in the magazine are loosely held in the serrations or feed ramps and frictional forces are reduced to a minimum. The magazine is completely filled by inserting cartridges up to C100 and the magazine is then in the position shown in FIG. 3A.

It is to be understood that the provision of the latches 447 and 462 is not necessary to the working of the invention, although they are considered to be extremely desirable for the dual function they each perform. In this respect, the ears 487, 488, in conjunction with lips 489, 461 respectively, prevent rotation of sprockets 42, 43 respectively to permit the magazine to be loaded through the feed throat 415. Secondly, the fingers 485, 486 of the latches permit drive from the intermediate sprocket to the outer sprocket to be through the latch 447 and from the inner sprocket to the intermediate sprocket through the latch 462 respectively, thereby enabling all of the cartridges in the magazine except cartridges C100, C99 to have a small amount of freedom of movement within the magazine. Having described the function and operation of the latches, it will be realised by those skilled in the art that latches having similar functions, although possibly requiring differing components to perform each of the two functions could be designed, with advantage, for use with the Soumi-type magazine.

Referring now to FIG. 13, there is shown an alternative form of last round stop actuator in which a compression spring 413' and 414' are inserted in a bore of the rod 407. The action of the plunger 414' is such that as the rod 407 moves up the feed ramp so the plunger 414' is extended by the force of spring 413' and when the arm 406 is fully extended so the plunger 414' abuts the last round stop mechanism in the gun receiver.

We claim:

1. A drum magazine for a gun including a stationary housing, an inner rotatably mounted member and an outer rotatably mounted member substantially concentric therewith, drive means for rotating the members in a first direction, stop means for limiting rotation of the outer member with respect to the housing, and latch means between the outer member and the housing arranged to lock when the stop means limit the rotation of the outer member to thereby prevent rotation of the outer member in a counter direction to the first direction until the inner member is rotated in said counter direction a predetermined amount.

2. A drum magazine as claimed in claim 1, wherein said members each comprise a substantially concentric sprocket means, each said sprocket means including a tubular member and having an outer periphery provided with a plurality of serrations arranged to nest a plurality of cartridges.

3. A drum magazine as claimed in claim 2, wherein more than two sprocket means are provided, and the stop means comprise abuttable stop members provided between the housing and the outermost sprocket means and between adjacent sprocket means except between the innermost sprocket means and the sprocket means adjacent thereto.

4. A drum magazine as claimed in claim 3, wherein further latch means are provided between adjacent sprocket means except between the innermost sprocket means and the sprocket means adjacent thereto, each said latch means being engageable when the cooperating stop members abut each other such that each said latch means prevent rotation of an associated latched sprocket means until the serrations thereof are required to be filled with cartridges.

5. A drum magazine as claimed in claim 4, wherein the latch means between the housing and the outermost sprocket means comprise a strip member pivotally connected to the outermost sprocket means and spring biassed toward the inner peripheral wall of the housing, and a recess in said peripheral wall, the strip member having an ear for engaging with the lip of the recess when the stop members associated with the housing and the outermost sprocket means abut.

6. A drum magazine as claimed in claim 5, wherein the further latch means between adjacent sprocket means comprise a strip member pivotally connected to the inner of the two adjacent sprocket means which is spring biassed toward the inner wall of the tubular member of the adjacent outer sprocket means, and a recess in said inner wall, the strip member of the further latch means having an ear for engaging with a lip of the recess in said inner wall when the stop members associated with the adjacent sprocket means abut.

7. A drum magazine as claimed in claim 5, wherein said strip member has a tang on the opposite side of the associated pivot from the ear which tang passes through the tubular member of the sprocket means to which it is attached and toward the adjacent inner sprockey means, whereby the tang is arranged to have a length sufficient to be contacted by a cartridge on said adjacent inner sprocket means for the strip member to be rotated thereby such that the ear of the strip member disengages its associated lip and permits the sprocket means to which the strip member is attached to rotate.

8. A drum magazine as claimed in claim 7, wherein the strip member is located in the wall of the tubular member of the sprocket means to which the strip member is attached and arranged to be depressed therein by cartridges on said sprocket means.

9. A drum magazine as claimed in claim 2, wherein the sprocket means each comprise the tubular member with at least two circular, radially extending flanges spaced therealong, each flange having serrations arranged to nest a plurality of cartridges therebetween, the serrations of the innermost sprocket means being spaced from the inner surface of the next adjacent outer sprocket means by substantially the same distance as the serrations of the outermost sprocket means are from the housing interior peripheral wall, a cartridge feed aperture in each tubular member except the innermost for permitting cartridges to pass through the apertured tubular members and feed ramps arranged to guide cartridges from each of the sprocket means to a feed throat of the housing.

10. A drum magazine as claimed in claim 9, wherein the strip member has a finger adjacent said ear but directed inwardly to pass through an aperture in the tubular member of the sprocket means to which said strip member is attached, said finger having a length and position such that when the strip member is depressed by cartridges it is displaced between cartridges on the inner adjacent sprocket means to rotate said adjacent sprocket means in a direction against the force of the drive means to thereby free the pressure on the cartridges in the feed ramps.

11. A drum magazine as claimed in claim 2, wherein each sprocket means is provided with the serrations directly in the outer periphery of the tubular member.

12. A drum magazine as claimed in claim 1, wherein the rotatably mounted members are concentrically arranged within the housing and the outermost member comprises a base plate and cartridge guide rails extending from said base plate which define substantially concentric cartridge paths and a bridge linking said paths.

13. A drum magazine as claimed in claim 12, wherein the inner member is a driving means which comprises a spring driven rotor, and a pivotal pusher connected to said rotor for applying force to push the cartridges around said paths.

14. A drum magazine for a gun as claimed in claim 1, wherein there is provided a connector having a part thereof attached to one of said members through which drive is capable of predeterminedly passing from one of said members to the other said member such that the members rotate together and wherein disconnection of said connector enables one member to rotate with respect to the other member.

15. A drum magazine as claimed in claim 14, wherein both members are capable of carrying cartridges.

16. A drum magazine as claimed in claim 15, wherein the members are sprocket means each having an outer periphery having a plurality of serrations arranged to nest a plurality of cartridges.

17. A drum magazine as claimed in claim 16, wherein the sprocket means comprise at least two circular, radially extending flanges axially spaced along a tubular member, each flange having serrations to nest a plurality of cartridges between said flanges.

18. A drum magazine as claimed in claim 2, wherein the housing is a plastic moulding which is pan-shaped and has a cover also formed by moulding plastics.

19. A drum magazine as claimed in claim 18, wherein a recessed track is formed in the housing and cover for locating and guiding the sprocket means.

20. A drum magazine as claimed in claim 2, wherein the sprocket means are made from a plastic material.

21. A drum magazine for a gun as claimed in claim 2, wherein said housing has a peripheral wall defining a circularly cross-sectioned interior, a cover for the housing, a feed throat extending through said wall for releasing cartridges from said housing, and at least two rotatable concentric sprocket means, the sprocket means each comprising a concentric tubular member, at least two circular, radially extending flanges spaced therealong, each flange having serrations to nest a plurality of cartridges therebetween, a cartridge feed aperture in each tubular member except the innermost for permitting cartridges to pass from the inner sprocket means to the other sprocket means, feed ramp means arranged to guide cartridges from each of the sprocket means to the feed throat, and a pusher mounted on the inner most sprocket means which is arranged to push those remaining cartridges not pushed by nested cartridges along the feed ramp means to the feed throat, wherein the pusher comprises a U-shaped member with the free ends thereof mounted on a pivot extending between the flanges of the innermost sprocket means, each limb of the U-shape being adjacent an associated flange and a rod located along the base of the U-shaped member which is nested in similar fashion to the cartridges on the flanges, whereby the length of the limbs of the U-shaped member is sufficient to enable the last cartridge in the magazine to be pushingly fed by the rod to the outer extremity of the feed throat.

22. A drum magazine as claimed in claim 21, wherein a last round stop actuator comprise a spring biassed member located adjacent to a limb of the pusher for travelling with said limb, whereby the spring biassed member is extended outside the housing when said pusher rod is extended toward the outer extremity of the feed throat.

23. A drum magazine as claimed in claim 22, wherein the last round stop actrator is a leaf spring having one end connected to the pivot of the pusher and the other end thereof connected to a button, whereby the button is adjacent and biassed toward the cover and protrudes therefrom when the rod is extended in the feed throat.

24. A drum magazine as claimed in claim 22, wherein the last round stop actuator is a plunger and spring assembly located in the rod of the pusher arranged so that the plunger is adjacent and biassed toward the cover and protrudes therefrom when the rod is extended in the feed throat.

25. A drum magazine as claimed in claim 2, wherein the sprocket means are driven by a torsion spring, there being a central axle and a slot in the tubular member of the innermost sprocket means with said torsion spring tensioned therebetween.

26. A drum magazine as claimed in claim 21, wherein stop means are provided for sequentially limiting the relative rotation between each of the sprocket means and the housing, which stop means serve to sequentially align the feed ramp means of the sprocket means in turn, starting with the outer sprocket means.

27. A drum magazine for a gun including a stationary housing, an inner rotatably mounted member and an outer rotatably mounted member substantially concentric therewith, drive means for rotating the members in a first direction, stop means for limiting rotation of the outer member with respect to the housing, latch means between the outer member and the housing arranged to lock when the stop means limit the rotation of the outer member to thereby prevent rotation of the outer member in a counter direction to the first direction until the inner member is rotated in said counter direction a predetermined amount, said latch means including a connector having a part thereof attached to one of said members through which drive is capable of predeterminedly passing from one of said members to the other said member such that the members rotate together and wherein disconnection of said connector enables one member to rotate with respect to the other member.

* * * * *